US009611576B2

(12) United States Patent
Newland et al.

(10) Patent No.: US 9,611,576 B2
(45) Date of Patent: Apr. 4, 2017

(54) METHOD OF CREATING A FRICTIONAL WASHING SURFACE

(71) Applicant: CALIBRE8 PTY LTD, Richmond (AU)

(72) Inventors: Ashley Martin Newland, Richmond (AU); Nick Dobson, Mont Albert Nth (AU)

(73) Assignee: CALIBRE8 PTY LTD, Richmond, Vic (AU)

( * ) Notice: Subject to any disclaimer, the term of this patent is extended or adjusted under 35 U.S.C. 154(b) by 358 days.

(21) Appl. No.: 14/385,796

(22) PCT Filed: Mar. 22, 2013

(86) PCT No.: PCT/AU2013/000285
§ 371 (c)(1),
(2) Date: Sep. 17, 2014

(87) PCT Pub. No.: WO2013/142895
PCT Pub. Date: Oct. 3, 2013

(65) Prior Publication Data

US 2015/0044404 A1 Feb. 12, 2015

(30) Foreign Application Priority Data

Mar. 26, 2012 (AU) ..... 2012901180

(51) Int. Cl.
*D06F 5/00* (2006.01)
*D06F 35/00* (2006.01)

(52) U.S. Cl.
CPC ..... *D06F 5/005* (2013.01); *D06F 5/00* (2013.01); *D06F 35/00* (2013.01); *Y10T 156/1039* (2015.01); *Y10T 428/1334* (2015.01)

(58) Field of Classification Search
CPC . D06F 5/005; D06F 5/00; D06F 35/00; Y10T 428/1334; Y10T 1561/1039
See application file for complete search history.

(56) References Cited

U.S. PATENT DOCUMENTS

| | | | |
|---|---|---|---|
| 6,255,235 | B1 | 7/2001 | Hiraoka |
| 2003/0021945 | A1 | 1/2003 | Kelch |
| 2003/0126666 | A1 | 7/2003 | McNamara |

FOREIGN PATENT DOCUMENTS

| | | | |
|---|---|---|---|
| DE | 10161050 | A1 | 6/2003 |
| EP | 1676947 | A1 | 7/2006 |

(Continued)

OTHER PUBLICATIONS

International Search Report prepared by the Australian Patent Office on Jul. 18, 2013, for International Application No. PCT/AU2013/000285.

*Primary Examiner* — Michael C Miggins
(74) *Attorney, Agent, or Firm* — Berg Hill Greenleaf Ruscitti LLP

(57) ABSTRACT

The present invention relates to a method of concurrently creating a frictional washing surface and joining the frictional washing surface to the surface of a housing material for a sealable waterproof bag for washing one or more textile items, the method including: i) applying a quantity of a polymer to the surface of the housing material for the sealable bag; ii) positioning a tool on the quantity of the polymer, the tool including a void region containing depressions and/or projections complementary to the shape of the frictional washing surface; and iii) applying heat and/or a current and/or a frequency to the tool to soften the polymer and allow it to form the shape of the frictional washing surface and concurrently join the frictional washing surface to the housing material for the sealable bag.

17 Claims, 8 Drawing Sheets

(56) References Cited

FOREIGN PATENT DOCUMENTS

| | | | |
|---|---|---|---|
| WO | WO 2010/007538 | A1 | 1/2010 |
| WO | WO 2011/146965 | A1 | 12/2011 |

METHOD OF CREATING A FRICTIONAL WASHING SURFACE

CROSS REFERENCE TO RELATED APPLICATIONS

This application is a national stage application under 35 U.S.C. 371 and claims the benefit of PCT Application No. PCT/AU2013/000285 having an international filing date of Mar. 22, 2013, which designated the United States, which PCT application claimed the benefit of Australian Patent Application No. 2012901 180 filed Mar. 26, 2012, the disclosures of each of which are incorporated herein by reference.

FIELD OF THE INVENTION

The present invention relates to a method of concurrently creating a frictional washing surface and joining the frictional washing surface to the surface of a housing material for a sealable waterproof bag for washing one or more textile items.

BACKGROUND

Using sealable waterproof bags with frictional washing surfaces inside provides travellers with a convenient and lightweight device for washing clothing when they are away from home. Such bags provide an alternative to soaking clothes in a basin or paying to have their clothing washed.

To wash clothing, users add 2-4 liters of water, a small amount of cleaning material (e.g. shampoo, body wash, washing liquid or powder, etc.) and several items of dirty clothing. The bag is sealed and air may be expelled through a valve. A user then places the bag on a table or the floor and rubs the clothing against the inner frictional washing surface for 20-40 seconds. The clothing may then be removed and rinsed. Optionally, the bag may be provided with an external grip surface (backing the frictional washing surface) to prevent the bag from sliding and/or to prevent the frictional washing surface from bunching up.

Such bags may have a volume of between about 2 L and 40 L and may weigh between about 30 g and 1500 g. A particularly effective sealing mechanism that may be used to seal the bag is a roll-down seal (these may include fabric webbing straps or rubber/plastic stiffeners that are brought together before rolling the straps or stiffeners down the bag 3-4 times and clipping the ends of the seal together). Other seals may be used such as waterproof zippers, fold-over seals, zip-lock seals, drawstrings, crimp seals, releasable glue/sticky seals, hydrophobic material seals, clamping seals, etc.

Creating and applying the frictional washing surface to the bag is a complex and involved process. For example, the frictional washing surface may be produced by injection moulding and then must be adhered to the housing material of the bag. This involves complex and expensive tooling and several steps to arrive at the final product. It is therefore desirable to provide an improved method for producing the sealable waterproof bags with the frictional washing surfaces for washing clothing.

DETAILED DESCRIPTION

The present invention provides a method of concurrently creating a frictional washing surface and joining the frictional washing surface to the surface of a housing material for a sealable waterproof bag for washing one or more textile items, the method including: i) applying a quantity of a polymer to the surface of the housing material for the sealable bag; ii) positioning a tool on the quantity of the polymer, the tool including a void region containing depressions and/or projections complementary to the shape of the frictional washing surface to be produced; and iii) applying heat and/or a current and/or a frequency to the tool to soften the polymer and allow it to form the shape of the frictional washing surface and concurrently join the frictional washing surface to the housing material for the sealable bag. The housing material may be placed on a conductive surface to allow conductivity of the heat and/or a current and/or a frequency through the polymer and housing material (e.g. a conductive plate).

This method is much more time and cost efficient than previous methods, as the amount of tooling required and the time taken to produce the bag is reduced. Furthermore, the method eliminates a manufacturing step as the frictional washing surface is created concurrently to it being joined to the surface of the housing material for the bag. The housing material may already be constructed in the shape of the bag or may be a linear sheet that will be used to construct the bag.

The term 'frictional washing surface' as used herein is intended to mean a surface, which includes raised portions and/or depressed portions that increase the friction between the surface and one or more textile items (e.g. clothing, hosiery, linen, towels, etc.), which are rubbed along or across the surface.

As set out above, the tool includes a void region containing depressions and/or projections complementary to the shape of the frictional washing surface that is to be created. As can be appreciated, the configuration of the depressions and/or projections may vary depending on the pattern of the frictional washing surface that is desired. In some embodiments, the void region volume may include depressions with depths between 0.5 mm and 8 mm, between 0.75 mm and 2 mm, between 0.9 mm and 1.6 mm or between 1 mm and 1.3 mm. The tool may be positioned such that the quantity of polymer is received, at least in part, in the void region. As the polymer softens, the polymer is drawn up to fill the void region (including the depressions). This process may be aided by applying pressure on the tool during step iii) to help draw the polymer into the depressions in the void region. Pressure may be applied, for example, using a hydraulic or pneumatic press. In some embodiments, the tool may include multiple void regions each containing depressions and/or projections. As can be appreciated, depressions in the void region will create projections in the resulting frictional washing surface. Projections in the void region may be used to create channels, fold lines, impressed logos, patterns or text in the resulting frictional washing surface.

As can be appreciated, the void region volume of the tool will vary depending on the area of the frictional washing surface to be created, the number of depressions and/or projections, the type of depressions and/or projections, and the dimensions of the depressions and/or projections. In some embodiments, the void region volume of the tool has a length by breadth area of greater than 2500 $mm^2$, greater than 10,000 $mm^2$, greater than 25,000 $mm^2$, greater than 50,000 $mm^2$, or greater than 60,000 $mm^2$. For example, the length and/or breadth of the void region volume may be greater than 50 mm, greater than 100 mm, greater than 150 mm, greater than 200 mm, greater than 250 mm or greater than 300 mm. As can be appreciated, in some embodiments, the frictional washing surface may cover a surface area of the housing material of greater than 2500 $mm^2$, greater than 10,000 $mm^2$, greater than 25,000 $mm^2$, greater than 50,000 $mm^2$, or greater than 60,000 $mm^2$.

The polymer that is applied to the surface of the housing material for the sealable bag may be in a solid, semi-solid or liquid state. For ease of application, the polymer may be used in a solid or semi-solid state as this may allow neater application and better positioning. In this regard, the polymer may be in the form of a sheet, a block, a mass, a ball, or any other shape. In some embodiments, the quantity of polymer may be provided as a single unit, multiple units or partially joined units. In some embodiments, a sheet of polymer may simplify the method as it may be cut to substantially match the shape of the tool (e.g. die cut) and may allow better formation of the frictional washing surface as the polymer could be more evenly distributed across the tool, thereby allowing better uptake of the polymer in the depressions of the tool's void region. Furthermore, using a sheet of polymer may reduce the amount of energy required to soften the polymer due to the distribution of the polymer. The term "sheet" is intended to include flat sheets, mesh sheets, patterned sheets, sheets of varying thickness, perforated sheets, etc. In some embodiments, a sheet with apertures may be prepared such that the polymer substantially lines up with the recesses of the tool and the apertures line up with projections or flat sections of the void region of the tool.

The frictional washing surface is not particularly limited and may include a relatively rigid washing surface or a flexible washing surface. For portability, a flexible washing surface may be beneficial. In some embodiments, the frictional washing surface may include a plurality of projections (e.g. ridges, knobs, or the like) and/or depressions (e.g. inundations, divots, channels, etc.). The depressions and/or projections may be elongate, connected to other projections or depressions, discrete units, uniformly shaped, or irregularly shaped. In some embodiments, the depressions and/or projections or parts thereof may have a tapered profile. For example, the depressions and/or projections may include a semi-circular, circular segment, semi-ellipsoidal, ellipsoidal segment, pyramidal, triangular shaped, pentagonal shaped, or wave shaped cross-section. Alternatively, the depressions and/or projections may include a quadrangular shaped cross-section. In some embodiments, the washing surface may include a plurality of differently shaped or sized depressions and/or projections. The depressions and/or projections may cover all or part of the washing surface. To minimise damage to the textiles, the washing surface may be a low abrasive surface (e.g. protrusions that are relatively blunt and/or composed of a resilient material).

In some embodiments, the washing surface may make up less than 50%, less than 40%, less than 30% or less than 20% of the total inner surface of the housing. The depressions and/or projections may be uniformly distributed on the housing and/or may be concentrated around a mid-point of the length or width of the housing, or around the mid-point of the length of the housing when sealed.

In some embodiments, the washing surface formed may include a base on which the depressions and/or projections are provided. The base may confer additional stability to the frictional washing surface, prevent depressions and/or projections from bunching up, and/or distribute pressure over a wider area, which may reduce wear on the housing or gripping surface (described below). In some embodiments, the base may have a thickness between approximately 0.05 mm and 1 mm. The formation of a base may provide additional strength and/or thickness to the portion of the housing that is likely to be under the most stress when in use and/or is likely to wear through quickest. The provision for a base may be designed into the shape of the void region and/or by the inclusion of a peripheral lip on the tool. Alternatively, the base may be formed by using a volume of polymer in excess of the void region volume of the tool and/or by adjusting the level or duration of the heat and/or a current and/or a frequency applied to the tool and/or the pressure applied to the tool.

In some embodiments, the void region volume of the tool may be between 2,000 $mm^3$ and 400,000 $mm^3$, between 5,000 $mm^3$ and 200,000 $mm^3$, between 15,000 and 150,000 $mm^3$, between 35,000 $mm^3$ and 85,000 $mm^3$ or between 45,000 $mm^3$ and 70,000 $mm^3$.

In some embodiments, the quantity of polymer may be equal to or greater than the volume of the void region of the tool. This can have the benefit of allowing the softened polymer to be taken up into substantially all the void region volume. Polymer quantities greater than the void region volume of the tool may be useful in allowing the softened polymer to be taken up into more than 70%, more than 80%, more than 90%, more than 95% or substantially all the void region volume and/or may provide for a base for the fictional washing surface (e.g. as described above). The void region of the tool may be calculated as the empty volume of the tool (e.g. the void region volume would be the same as the volume of a material required to fill the void region of the tool). Where a base of a particular thickness is desired, the volume of the base can be included in the calculations for the optimal quantity of polymer to be used.

As described above, the quantity of polymer may be provided as a sheet. In some embodiments, the sheet of polymer may have a thickness between 0.1 mm and 8 mm, between 0.2 mm and 4 mm, between 0.4 mm and 3 mm, or between 0.6 mm and 1 mm. In some embodiments, the thickness of the polymer sheet may be an average thickness of the sheet as sheets with varying thickness are also contemplated by the present invention. The required average thickness of the polymer in the form of a sheet may be determined with respect to the volume of the void region of the tool and the thickness of a base for the frictional washing surface that may be desired.

The polymer may be any polymer that is able to be softened by applying heat and/or a current and/or a frequency to the tool when positioned and subsequently polymerised by removing the heat and/or current and/or frequency and/or applying a polymerising agent. In some embodiments, the polymer may be a polymer with a dielectric constant greater than 1 or greater than 2 when measured using a high frequency of 27.12 MHz. The polymer may include a polymer selected from the group including: ABS, Acrylic, Aclar, APET, Barex 210, Barex 218, Cellulose acetate, Cellulose Acetate butyrate, Cellulose Nitrate, Cellulose triacetate, Ethyl Vinyl Alcohol (EVA), EVOH, Nylon (Polyamide), Pelathane, PET, PETG (polyester glycol), Pliofilm (rubber hydrochloride), Phenol-formeldehyde, Polyethylene, Polymethyl: Methylacrilate, Polyurethane, Polyurethane foam, Polyvinyl acetate, Polyvinyl chloride, Saran (polyvinylidene chloride), or derivatives or combinations of any of the foregoing. In some embodiments, the polymer may be a urethane polymer or a PVC polymer.

The tool may be composed of any suitable material that is able to soften the polymer by applying heat and/or a current and/or a frequency to the tool. In some embodiments, the tool is a metallic tool. In some embodiments, the tool may be composed of aluminium, steel, titanium, copper, iron, or a composite or alloy including any one or more of the foregoing. In some embodiments, the tool is an aluminium tool.

The heat and/or current and/or frequency applied to the tool may include high frequency welding (or radio frequency welding), vibration welding or ultrasonic welding. In some embodiments, applying heat and/or current and/or frequency may involve applying a radio frequency of approximately 27.12 MHz. The precise frequency and duration will depend on the type of polymer, the thickness and form of the polymer and the void region volume of the tool (e.g. the depth of recesses and/or the height of projections). In some embodiments, a mechanical pressure may be applied to the tool to press it against the quantity of polymer and the housing material. In some embodiments, the combination of the weight of the tool and gravity may provide ample pressure between the tool and the quantity of polymer and the housing material.

It will be appreciated that the heating current/frequency, time and pressure required will depend on a number of factors including, for example, the type of polymers, the thickness of the polymers, the surface area of the frictional washing surface to be formed, and the composition of the tool. In some embodiments, the optimal settings for the heating current, heating time and pressure may be determined by first testing with minimum power, minimum time (e.g. <1 or <2 seconds), and medium pressure. If the join is weak and/or the frictional washing surface is ill-formed, the time may be increased gradually up to 3 or 4 seconds. The power may then be increased incrementally until a good join and well-formed frictional washing surface is obtained. To minimise burning or arcing, the heating current may be kept as low as possible consistent with good join and frictional washing surface formation.

In some embodiments, a radio frequency of approximately 27.12 MHz may be applied to the tool for 0.25-10 seconds or 0.5 to 5 seconds to soften the polymer. The tool and a conductive bottom surface may act as electrodes to allow the frequency to be directed through the polymer and housing material.

As can be appreciated, the shape of the tool may be determined by the desired shape of the frictional washing surface. In some embodiments, the tool may include a raised peripheral lip. The peripheral lip may be used to contain the softened polymer during step iii. In some embodiments, the peripheral lip may also be used to define the thickness of the base of the frictional washing surface (if there is one). The thickness of the base may be the difference in height between the peripheral lip and the projections/depressions in the void region.

In some embodiments, the tool may include a channel adjacent to the periphery of the tool to take up excess softened polymer. In this regard, softened polymer is less likely to cross the periphery of the tool, which can look messy. The channel may be provided in conjunction with a peripheral lip or in the absence of a peripheral lip.

The housing material may include any suitable waterproof material. In some embodiments, the housing material may include any one of the polymers previously mentioned herein. In some embodiments, the housing material may include synthetic or natural fibres. The fibres may be individual fibres or may be part of a woven fabric, a non-woven fabric, filaments, threads or yarns. The fibres, fabrics, filaments, threads or yarns may be coated, encapsulated or impregnated with a polymer (including, for example any of the aforementioned polymers). In some embodiments, the fibres may be included in the housing as an unorganised arrangement of fibres (e.g. mixed with or coated onto a liquid polymer or polymer layer), matted together or included as an organised arrangement of fibres, filaments, threads or yarns (e.g. a woven fabric, scrim or one or more layers or lines of unidirectional fibres). The term scrim, as used herein is intended to mean a base fabric component created by laying out fibres, filament or thread in a grid pattern and joining them at the intersections (e.g. by knitting, tying or adhering). In some embodiments, the housing material may include a fabric with a fabric or fibre denier between 0.5 and 600, between 1 and 300, between 25 and 220, or between 30 and 80, and/or the fibre is a microfibre with a denier less than 0.5.

The fibres may include cellulose fibres, mineral fibres, polymer fibres, microfibres, vegetable fibres, wood fibres, or animal fibres. Examples of such fibres include: nylon fibres, polyester fibres (e.g. Dacron®, PET, PBT), ultra high molecular weight polyethylene fibres (e.g. Dyneema®, Spectra®, Pentex®, Certran®), liquid crystal polymer fibres (e.g. Vectran®, Zylon PBO®), aramid fibres (e.g. Kevlar® (including Kevlar®49 or Kevlar®Edge™), Technora®, Twaron®, Nomex®), carbon fibres, phenol-formaldehydes (PF), polyvinyl alcohol fibres (PVA), polyvinyl chloride fibres, polyolefin fibres (PP or PE), PBO Zylon fibres, PEN fibers (Polyethylene Napthalate), poly-urethane fibres, rayon fibres, cotton fibres, silk fibres, wool fibres, linen fibres, hemp fibres, coir fibres, and jute fibres.

In embodiments wherein the fibres, filaments, threads, yarns or fabrics are coated with a polymer, the polymer coat may be a thin coat (e.g. between 100 nm and 500 nm). In some embodiments, the polymer coat may be between 100 nm and 50 μm or between 100 nm and 200 μm, or between 100 nm and 300 μm, or between 50 μm and 200 μm. Thicker or thinner coatings are also contemplated by the present invention.

In some embodiments, the polymer used to coat, impregnate or encapsulate the fibres, filaments, threads, yarns or fabrics may be used in a quantity of between 4 $g/m^2$ and 400 $g/m^2$ or between 15 $g/m^2$ and 300 $g/m^2$, or between 20 $g/m^2$ and 30 $g/m^2$ or between 30 $g/m^2$ and 80 $g/m^2$. Higher or lower quantities are also contemplated by the present invention. When used to coat fabrics, the polymer may be provided on the inner surface, outer surface or both surfaces of the fabrics.

In some embodiments, the fabric may include a specific weave pattern or process to increase durability and/or reduce weight. For example, the fabric may include a ripstop fabric, a Cordura® fabric, a Kodra fabric, an Oxford weave fabric or a Taffeta® fabric. In some embodiments, the fibres may be laid side-by-side to form a uni-directional layer of fibres, thereby reducing creep or crimp that may occur with some woven fabrics. Multiple layers may be used with the fibre layers being oriented in different directions (e.g. 30°, 45° or 90° to the first layer) to increase strength of the fabric in multiple directions. In some embodiments, the waterproof housing may include a $CTF^3$ fabric (CUBIC TECH CORP) or Cuban fabric (plasma treated ultra high molecular weight polyethylene fibers and monofilament polyester film).

In some embodiments, the housing includes may include a nylon fabric, an acrylic fabric, a polyester fabric or vinyl fabric, the fabric coated on at least one side or impregnated with PVC, polyurethane, PET, EVA, ABS plastic, silicone or latex.

To facilitate effective joining of the frictional washing surface to the housing material, the housing material may include a polymer that has welding compatibility with the quantity of polymer applied to the housing material. In some embodiments, the polymers may be of a different type. In some embodiments, the polymers may be of the same type (e.g. both urethanes with different chemical compositions). In some embodiments, the polymers may be identical.

In some embodiments, the method may further include concurrently creating a grip surface on a surface of the housing material backing at least a portion of the position of the frictional washing surface, the method including the further step of iv): allowing some of the quantity of polymer to pass through the housing material to form the grip surface during step iii); or v) applying a second quantity of a polymer to the surface of the housing material backing at least a portion of the position of the frictional washing surface, wherein the second quantity of polymer is also joined to the housing material during step iii). Where two quantities of polymers are used, it will be appreciated that the polymers may be identical, of the same polymer type or polymers of different types. To help facilitate polymer passing through the housing material, the housing material may include one or more small apertures. Such apertures may have a diameter/width between 0.001 mm and 5 mm. The grip surface may be patterned by using a patterned tool (e.g. a tool with a void region containing projections or depressions).

Providing a grip surface can be advantageous in that it may allow the frictional washing surface to remain substantially in the same place during use (e.g. prevent the housing from sliding). If the washing surface moves as the textiles are rubbed against it and/or the projections/depressions bunch up (particularly if the frictional washing surface doesn't include a base as described above), the laundry device will be less effective. The gripping surface may also be advantageous in that it can provide a barrier between the waterproof housing and the surface it is used on, thereby reducing abrasion and wear of the housing material.

The polymer for the grip surface may include any of the polymers previously mentioned here and may include an elastomeric polymer. The polymer for the grip surface may be applied in the form of a sheet, a mesh, lattice, a blob, etc. In some embodiments, providing the grip surface as a sheet, a mesh, lattice that is approximately cut to the size of the tool may result in a neater looking product. In some embodiments, a sheet, mesh or lattice with large apertures may be advantageous as it may provide a latticed or gridded grip surface. When used on a smooth wet surface, the water may be at least partially displaced into the apertures or recesses of the grip surface thereby improving the ability of the gridded or latticed grip surface to grip the smooth surface.

In some embodiments, the grip surface may have a static or dynamic coefficient of friction greater than 0.5, greater than 0.75, greater than 1.0, greater than 1.25, greater than 1.50, greater than 2.0, greater than 2.5, or greater than 3.0. In some embodiments, the grip surface that is formed may have a coefficient of friction that is greater than the coefficient of friction of the non-grip portion of the housing material by at least 25%, at least 50%, at least 100%, at least 200%, at least 300%, at least 400%, at least 500%, at least 600%, at least 700% or at least 800%.

The present invention also provides for a housing material for a sealable waterproof bag with an inner frictional washing surface for washing a textile item produced according to the method described herein. The housing material may already be in the form of the bag or may be used in construction of the bag.

The present invention also provides a tool with a void region containing depressions and/or projections complementary to the shape of the frictional washing surface, when used to produce the bag described herein using the method described herein.

Examples of Specific Embodiments of the Invention

Reference will now be made to the following examples which describe particular embodiments of the present invention. These examples should not be taken as limiting the scope of the claims.

BRIEF DESCRIPTION OF THE FIGURES

As shown in FIG. 1; a quantity of polymer 22 is applied to housing material 20; tool 10 is positioned on polymer 22; heat and/or current and/or a high frequency is applied to soften polymer 22 and draw it into void region 24 of tool 10 to form the shape of frictional washing surface 30; tool 10 is removed and polymer 22 is allowed to cool; and construction of sealable waterproof bag 40 may then be completed. Optionally, a second polymer 38 may be applied beneath housing material 20 and on a second tool 11 to allow grip surface 48 to be formed on housing material 20 backing the frictional washing surface 30 that is formed. Also optionally, pressure may be applied on tool 10 to help draw polymer 22 into void region 24.

An embodiment of the present invention will now be described with respect to the drawings in FIG. 2 and FIG. 3.

Figure 1:
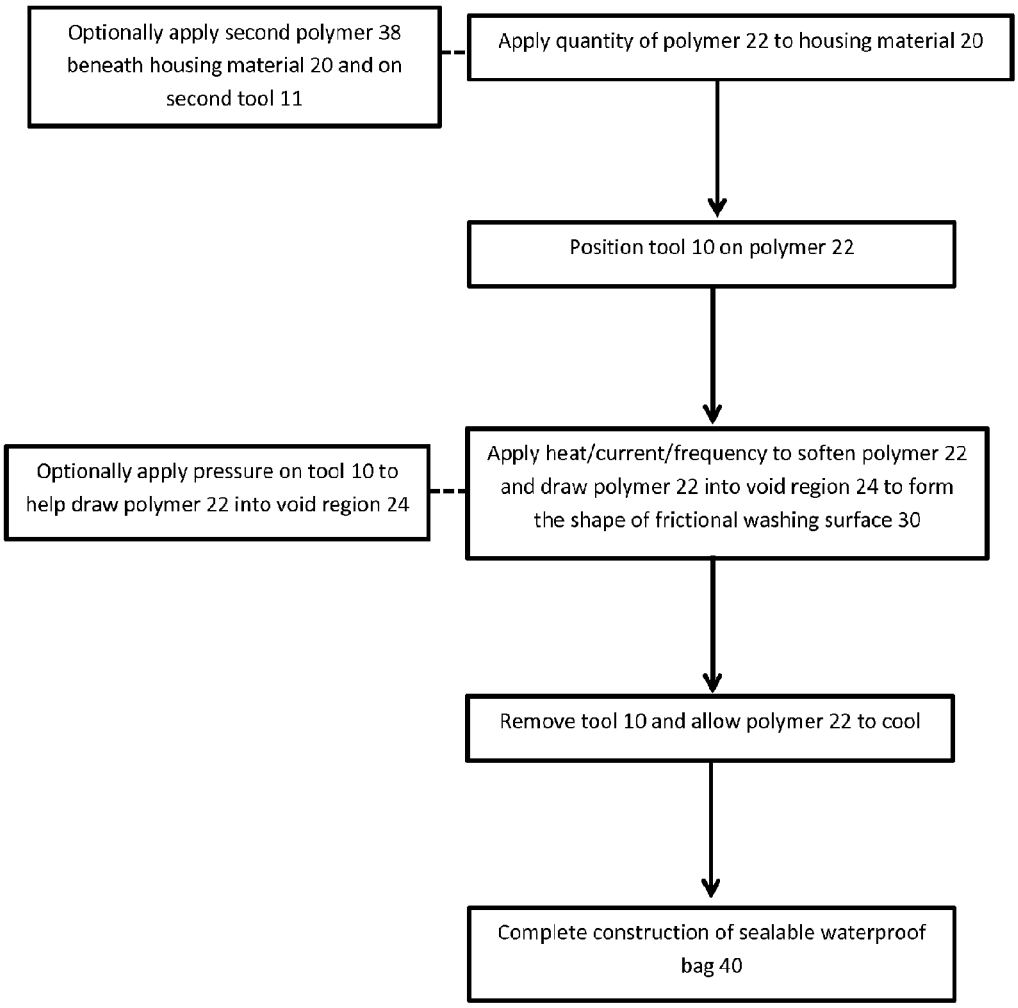
FIG. 1 shows a flow chart of the method according to an embodiment of the present invention.
Figure 2:
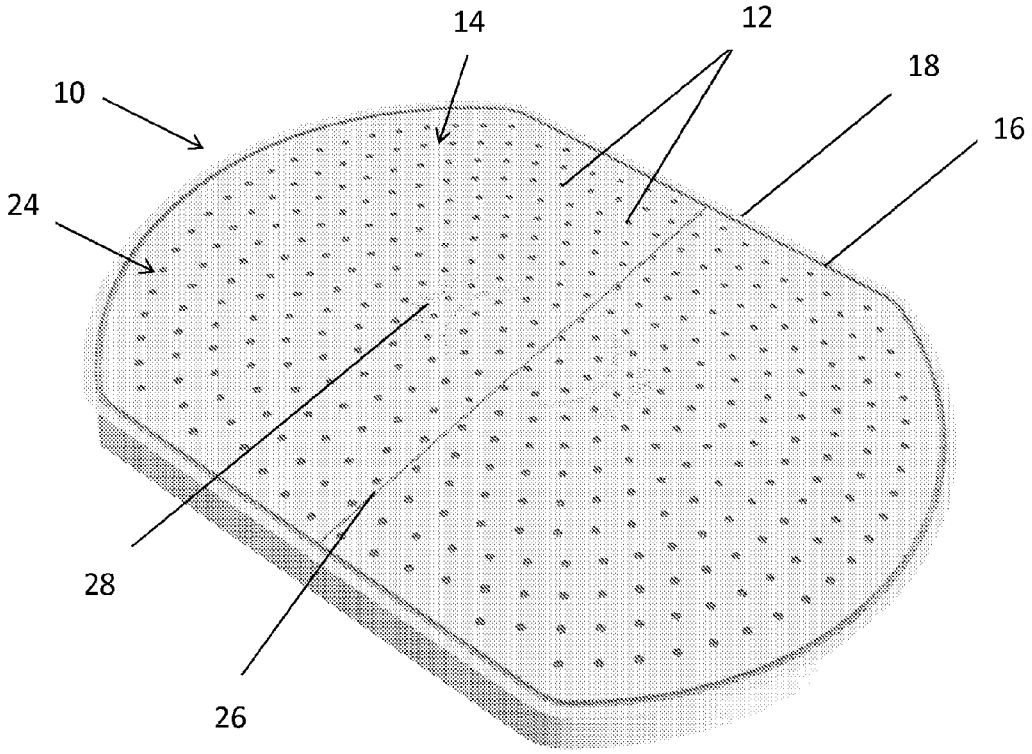
FIG. 2 shows a perspective view drawing of a tool according to an embodiment of the present invention.
Figure 3A:
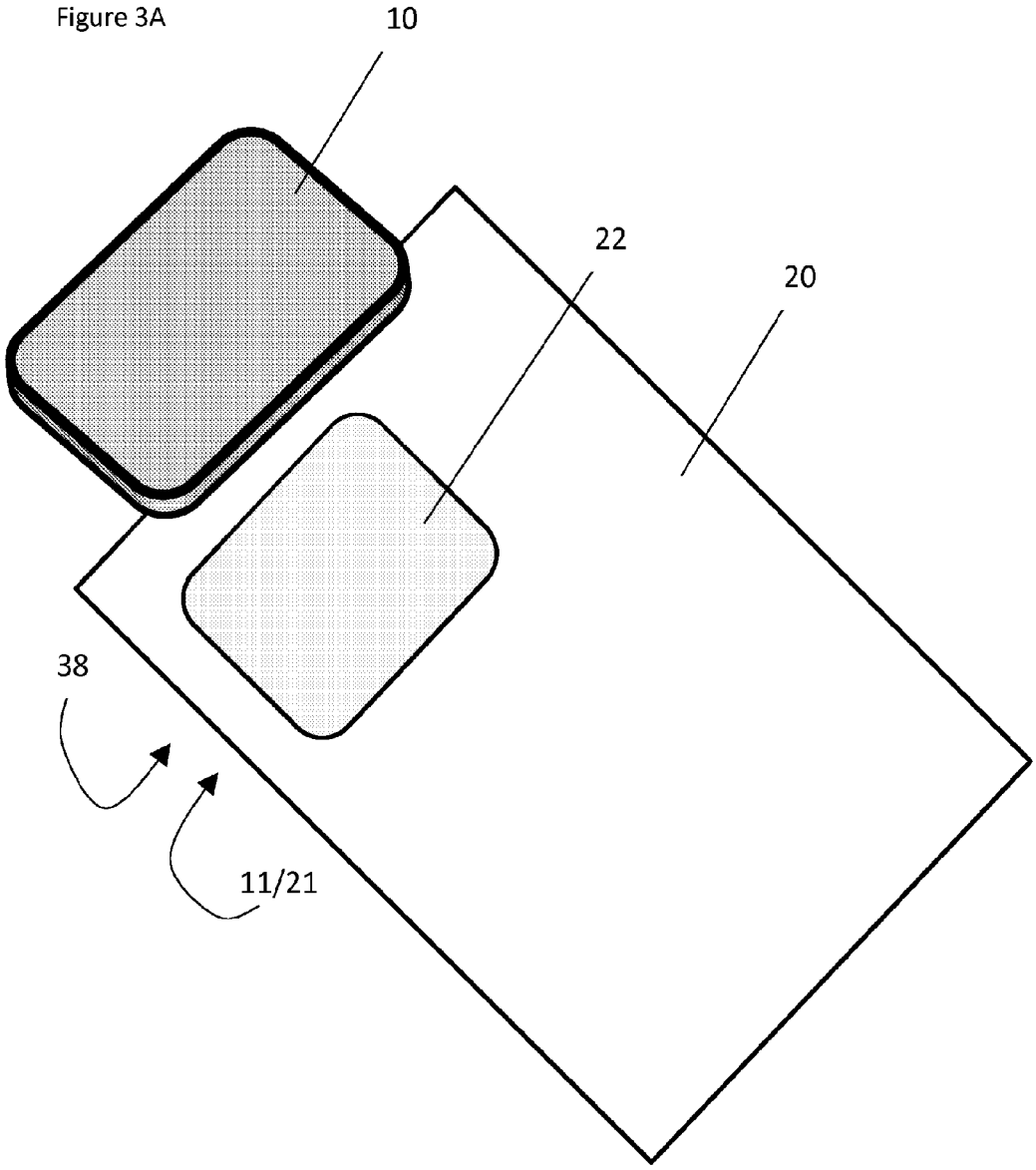
FIG. 3A and FIG. 3B show perspective view drawings of the tool of FIG. 2 being used according an embodiment of the present invention.
Figure 3B:
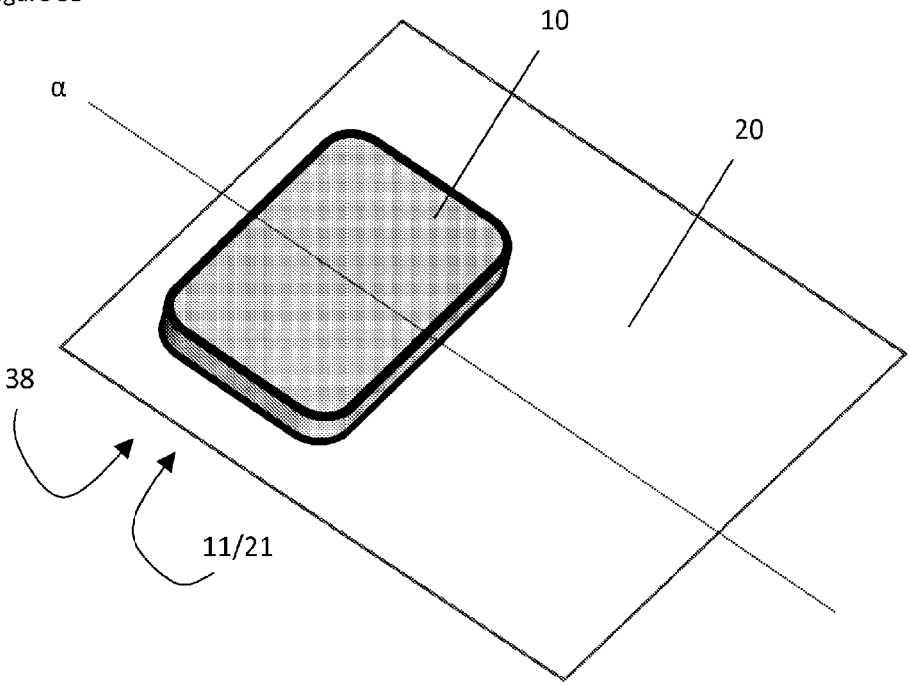
Figure 3C:
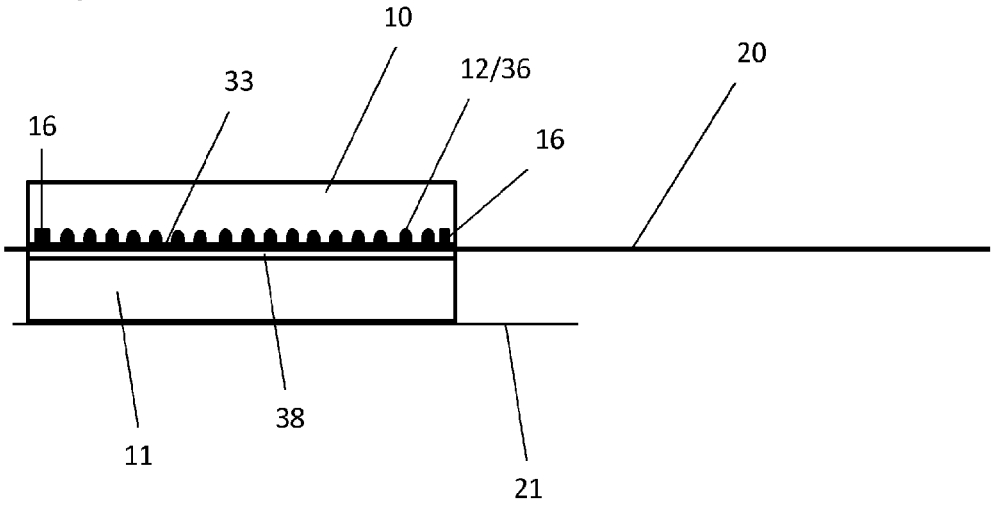
FIG. 3C shows a not-to-scale representation of the cross section α from FIG. 3B.
Figure 3D:
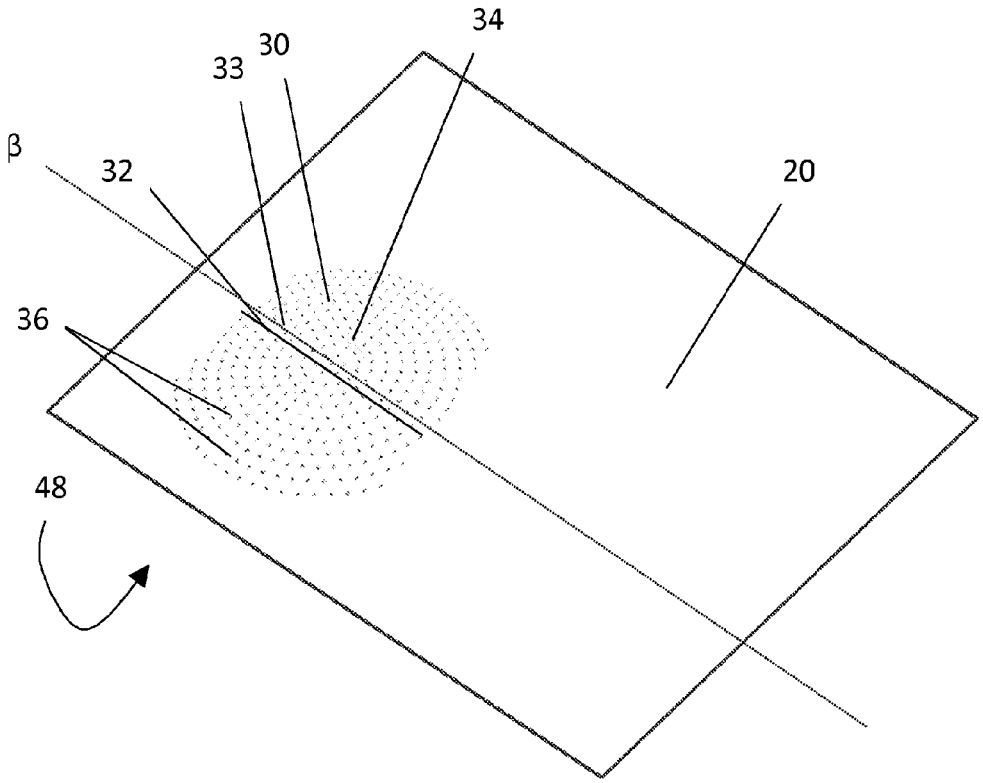
FIG. 3D shows a perspective drawing of the frictional washing surface formed using the tool from FIG. 3A and FIG. 3B.
Figure 3E:
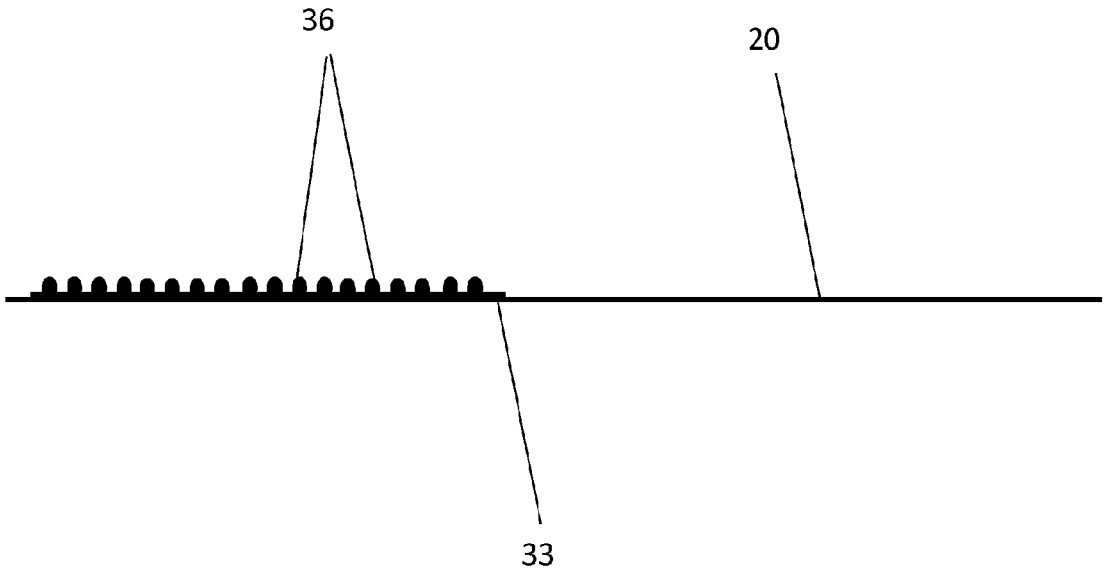
FIG. 3E shows a not-to-scale representation of the cross section β from FIG. 3D.

FIG. 2 shows tool 10 with void region 24. Void region 24 is provided on face 14 and includes recesses 12. Tool 10 also includes channel 16 that runs adjacent to the periphery of tool 10. Lip 18 is also shown. Ridge 26 is provided half way along tool 10 and text ridges or channels 28 may be provided with a depth or height of approximately 0.2-0.4 mm. Tool 10 is made from aluminium and has approximate dimensions of 300 mm×240 mm×15 mm (length×breadth×depth). Recesses 12 have a depth of approximately 1-1.3 mm.

FIG. 3 shows tool 10 in use concurrently creating a frictional washing surface 30 and joining the frictional washing surface 30 to the surface of housing material 20 for sealable waterproof bag 40. As shown in FIG. 3A, polymer 22 in the form of a die cut sheet of urethane or PVC (~0.6 mm thickness) is laid onto housing material 20, a 40 denier woven nylon fabric coated with urethane on one side. Tool 10 is brought down onto polymer 22 (FIG. 3B). Optionally, second polymer 38 may be placed on second tool 11 and under housing material 20 to form a grip surface. Tool 11 or housing material 20 lies on conductive plate 21. Once tool 10 is in place, a radio frequency of approximately 27.12 MHz is applied to tool 10 for 0.5 to 5 seconds as well as a downward pressure. The radio frequency and heat generated thereby acts to soften polymer 22. The effect of the softening of polymer 22 and the pressure applied by tool 10 draws polymer 22 into recesses 12 to form knobs 36 (FIGS. 3C and 3D). Excess softened polymer is taken up by channel 16 and inhibited from leaking outside the area under tool 10 by raised lip 18. Furthermore, the urethane coating of the housing material 20 is also softened and melds with polymer 22. Ridge 26 of tool 10 produces fold line 32 in base 33 of frictional washing surface 30. Fold line 32 aids in folding the completed frictional washing surface. Base 33 is approximately 0.3 mm thick and is slightly raised on housing material 20 and connects knobs 36 (FIG. 3E). Once tool 10 is removed, cooling is allowed to occur with polymer 22 now in the shape of frictional surface 30, securely joined to housing material 20. Text ridges or channels 28 result in impressed or embossed text 34 on frictional washing surface 30.

Figure 4:
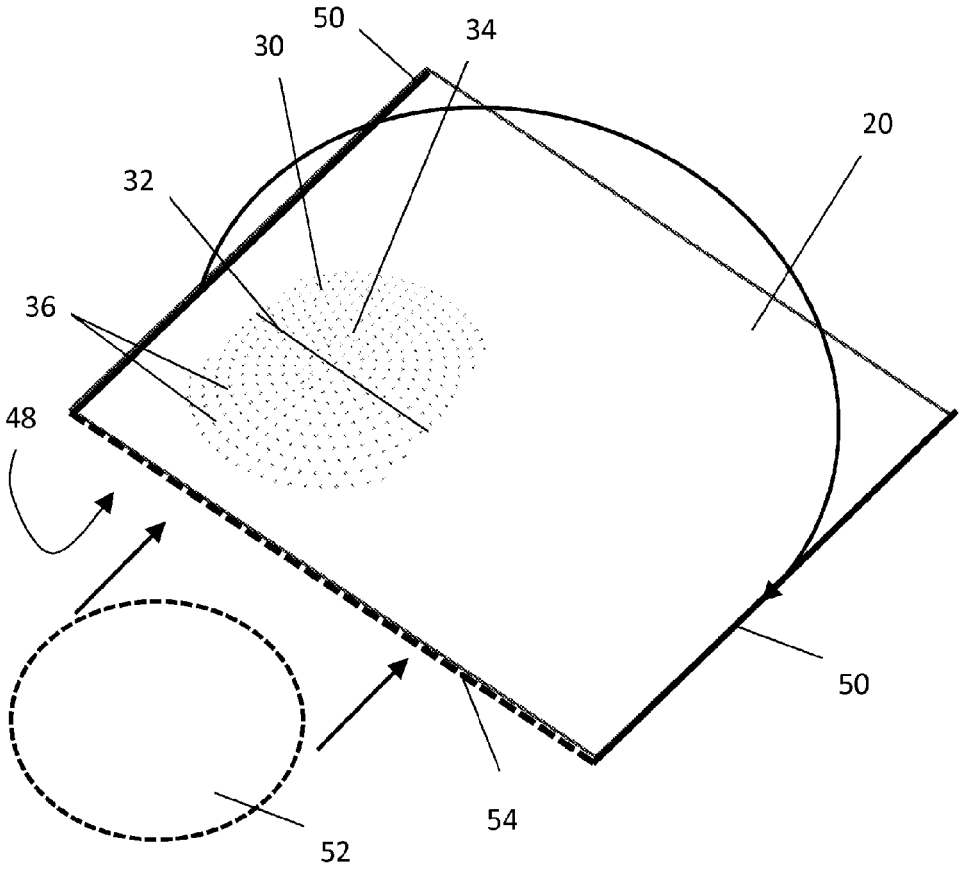
FIG. 4 shows a perspective drawing of a sealable waterproof bag for washing one or more textile items constructed using the housing material including the frictional washing surface from FIG. 3D.
Figure 5:
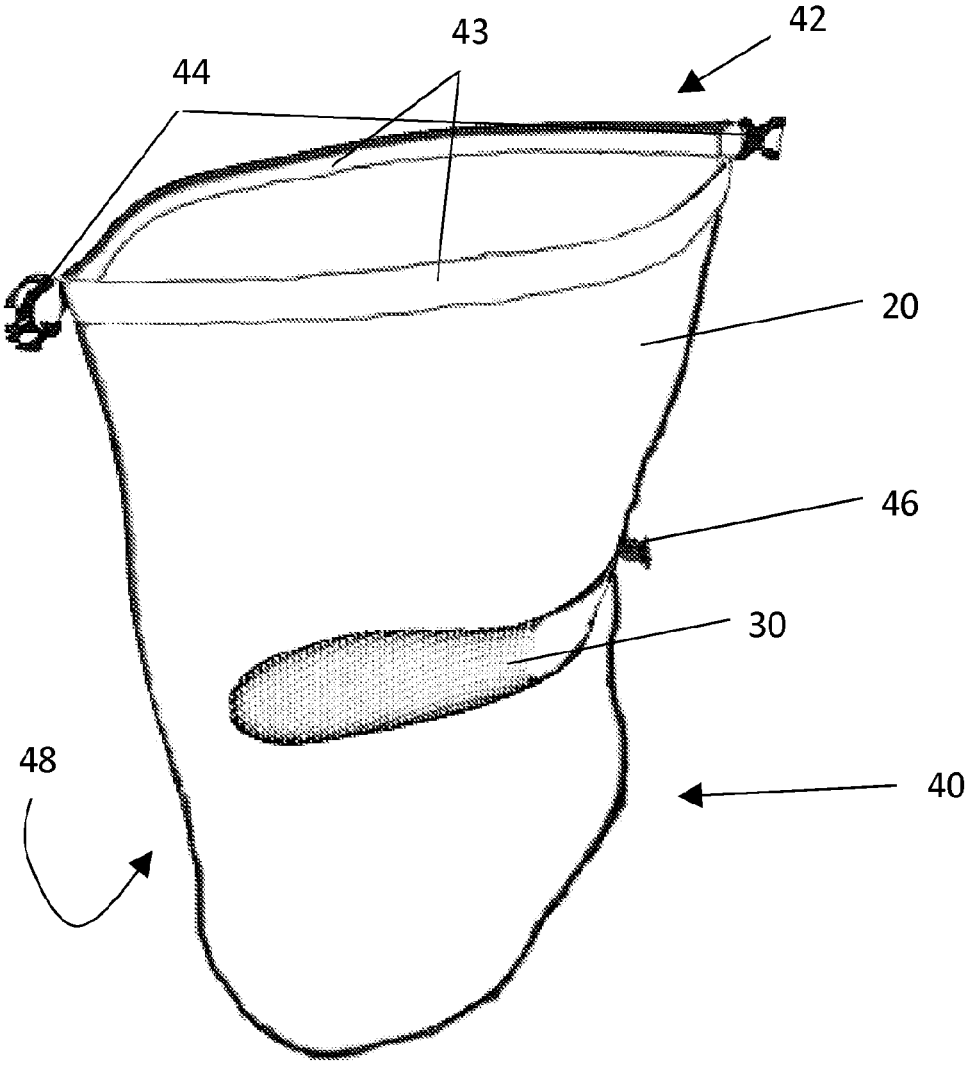
FIG. 5 shows a perspective drawing of a finished sealable waterproof bag produced according to an embodiment of the present invention.

Construction of sealable bag 40 using housing material 20 may then be completed by sewing or welding the required seams. As shown in FIG. 4, edges 50 are joined together and end housing piece 52 is attached to edge 54. As shown in FIG. 5, sealable bag 40 may also include rolldown seal 42 including straps 43 and clips 44. Sealable bag 40 may also include valve 46. Optionally, sealable bag 40 may further include grip surface 48 on the outside of housing material 20, backing frictional washing surface 30.

The claims defining the invention are as follows:

1. A method of concurrently creating a frictional washing surface and joining the frictional washing surface to the surface of a housing material for a sealable waterproof bag for washing one or more textile items, the method including:

i) Applying a quantity of a polymer to the surface of the housing material for the sealable bag;

ii) Positioning a tool on the quantity of the polymer, the tool including a void region containing depressions and/or projections complementary to the shape of the frictional washing surface to be produced; and iii) Applying heat and/or a current and/or a frequency to the tool to soften the polymer and allow it to form the shape of the frictional washing surface and concurrently join the frictional washing surface to the housing material for the sealable bag.

2. The method of claim 1, wherein the void region of the tool has a volume between 2,000 $mm^3$ and 400,000 $mm^3$.

3. The method of claim 1, wherein the tool is composed of aluminium, steel, titanium, copper, iron, or a composite or alloy including any one or more of the foregoing.

4. The method of claim 1, wherein step iii) includes applying a current or frequency of approximately 27.12 mHz.

5. The method of claim 1, wherein the housing material includes a fabric with a fabric or fibre denier between 0.5 and 600, between 1 and 300, between 25 and 220, or between 50 and 100, and/or the fibre is a microfibre with a denier less than 0.5.

6. The method of claim 1, wherein the housing includes a ripstop fabric, a Cordura fabric, a Kodra fabric, an Oxford weave fabric, a Taffeta fabric, a $CTF^3$ fabric or a Cuban fabric.

7. The method of claim 1, wherein the housing includes a nylon fabric, an acrylic fabric, a polyester fabric or vinyl fabric, the fabric coated on at least one side or impregnated with PVC, polyurethane, silicone or latex.

8. The method of claim 1, wherein the housing material includes the same polymer type as the polymer applied to the surface of the housing material.

9. The method of claim 1, further including concurrently creating a grip surface on a surface of the housing material backing at least a portion of the position of the frictional washing surface, the method including the further step of:

iv) allowing some of the quantity of polymer to pass through the housing material to form the grip surface during step iii);

v) or applying a second quantity of a polymer to the surface of the housing material backing at least a portion of the position of the frictional washing surface, wherein the second quantity of polymer is also joined to the housing material during step iii).

10. The method of claim 1, wherein the polymer referenced in any of the foregoing claims includes a polymer with a dielectric constant greater than 1 or greater than 2.

11. The method of claim 1, wherein the polymer is selected from the group including: polyurethane, polyvinyl acetate, polyvinyl chloride, nylon, EVA or ABS plastics.

12. The method of claim 1, wherein the quantity of polymer is provided as a sheet of polymer.

13. The method of claim 12, wherein the sheet of polymer has an average thickness between 0.2 mm and 3 mm.

14. The method of claim 12, wherein the sheet of polymer has an average thickness between 0.8 mm and 1.4 mm.

15. The method of claim 1, wherein the housing material includes synthetic of natural fibres.

16. The method of any one of claim 15, wherein the fibres are part of a woven fabric, a non-woven fabric, filament, thread or yarn.

17. The method of claim 15, wherein the fibres, filament, thread, yarn or fabric are coated, encapsulated or impregnated with a polymer.

* * * * *